US011674417B2

(12) United States Patent
Baxter

(10) Patent No.: US 11,674,417 B2
(45) Date of Patent: Jun. 13, 2023

(54) SOUND SUPPRESSOR

(71) Applicant: Cameron M. Baxter, Dillsburg, PA (US)

(72) Inventor: Cameron M. Baxter, Dillsburg, PA (US)

( * ) Notice: Subject to any disclaimer, the term of this patent is extended or adjusted under 35 U.S.C. 154(b) by 377 days.

(21) Appl. No.: 17/043,845

(22) PCT Filed: Apr. 5, 2019

(86) PCT No.: PCT/US2019/025940
§ 371 (c)(1),
(2) Date: Sep. 30, 2020

(87) PCT Pub. No.: WO2019/195649
PCT Pub. Date: Oct. 10, 2019

(65) Prior Publication Data

US 2021/0123364 A1 Apr. 29, 2021

Related U.S. Application Data

(60) Provisional application No. 62/653,813, filed on Apr. 6, 2018.

(51) Int. Cl.
*F01N 1/06* (2006.01)
*F41A 21/30* (2006.01)
(Continued)

(52) U.S. Cl.
CPC ..... *F01N 1/06* (2013.01); *F01N 1/023* (2013.01); *F41A 21/30* (2013.01); *G10K 5/00* (2013.01);
(Continued)

(58) Field of Classification Search
CPC ..... F41A 21/30; F01N 1/06; G10K 11/161; G10K 11/175
See application file for complete search history.

(56) References Cited

U.S. PATENT DOCUMENTS 4,429,656 A 2/1984 Weisenberger
4,576,083 A * 3/1986 Seberger, Jr. ..... F01N 1/08 89/14.4
(Continued)

FOREIGN PATENT DOCUMENTS

FR 2766870 A1 * 2/1999 ..... F01N 1/083

OTHER PUBLICATIONS

English translation of FR-2766870-A1, accessed Dec. 5, 2022 from USPTO Search tool. (Year: 1999).*
(Continued)

*Primary Examiner* — Jeremy A Luks
(74) *Attorney, Agent, or Firm* — John H. Choi & Associates

(57) ABSTRACT

A sound suppressor for use in firearms, internal combustion engines, and numerous other sound-generating devices includes a structure having a plurality of ports, openings, or orifices which function as whistles and which suppress sound from a source of the sound using destructive interference. A combination of varying distances between components is configured for delaying the wave from one port or whistle to the next, so that the whistles are partially out of phase with respect to time, and placing the orifices of the whistles a certain distance apart to compensate for the remaining phase difference in order to create the desired destructive interference.

28 Claims, 19 Drawing Sheets

(51) Int. Cl.

| | |
|---|---|
| ***G10K 11/16*** | (2006.01) |
| ***G10K 11/175*** | (2006.01) |
| ***F01N 1/02*** | (2006.01) |
| ***G10K 5/00*** | (2006.01) |

(52) U.S. Cl.
CPC ..... *G10K 11/161* (2013.01); *G10K 11/175* (2013.01); *F01N 2590/02* (2013.01); *F01N 2590/08* (2013.01)

(56) References Cited

U.S. PATENT DOCUMENTS

| | | | | |
|---|---|---|---|---|
| 4,907,488 | A * | 3/1990 | Seberger | F41A 21/30 89/14.4 |
| 5,423,242 | A * | 6/1995 | Schuemann | F41A 21/28 89/14.3 |
| 10,520,272 | B1 * | 12/2019 | Carson | F41A 21/36 |
| 11,067,354 | B2 * | 7/2021 | Lindström | F41A 21/30 |
| 2007/0107982 | A1 | 5/2007 | Sullivan | |
| 2010/0163336 | A1 | 7/2010 | Presz, Jr. | |
| 2012/0272818 | A1 * | 11/2012 | Dueck | F41A 21/30 29/896.2 |
| 2013/0227871 | A1 * | 9/2013 | Stone | F41A 21/30 42/76.1 |
| 2017/0191779 | A1 * | 7/2017 | Myers | F41A 21/48 |
| 2017/0321985 | A1 | 11/2017 | Bray | |
| 2018/0164065 | A1 * | 6/2018 | Mohler | F41A 21/30 |
| 2018/0274873 | A1 * | 9/2018 | Thomas | F41A 21/30 |

OTHER PUBLICATIONS

International Searching Authority/US, PCT/US19/025940, International Search Report and Written Opinion, dated Jun. 28, 2019.

* cited by examiner

SOUND SUPPRESSOR

CROSS-REFERENCE TO RELATED APPLICATION

This is a national stage application of International Application No. PCT/US/19/025940, filed on Apr. 5, 2019, which claims priority to U.S. Provisional Application No. 62/653,813, filed Apr. 6, 2018, both of which are incorporated by reference in their entireties.

FIELD

The present disclosure relates to noise and sound suppressors and in particular to suppressors and silencers for internal combustion engines and firearms.

BACKGROUND

Chemical combustion is used in all manner of everyday tasks, from powering the internal combustion engines of vehicles, to acting as the propellant for the projectiles in firearms. Invariably, these chemical processes create soundwaves, and a variety of methods have been attempted to mitigate noise produced by chemical combustion processes. Most automobiles utilize some type of muffler to quiet their engines. Firearms suppressors (also known as silencers) provide a similar kind of benefit to shooters. Both mufflers and firearms suppressors operate by acting as heat exchangers, converting the sound energy to heat energy by diverting or trapping the pressurized gas in chambers within the muffler/suppressor body. The pressurized gas is forced to expand into the spaces within the muffler/suppressor, thereby decreasing the pressure, velocity and temperature of the gases prior to their release into the atmosphere. There are several areas in which these techniques have proven ineffective. Many internal combustion engines are still quite noisy (especially leaf blowers, and other two-stroke engines). Firearms manufacturers are still trying to improve upon suppressor technology that is over a century old.

From their earliest designs to the more modern ones, mufflers and firearms suppressors have relied largely on the use of baffled canisters. Several designs have attempted to make use of overboard venting of escaping gases prior to the muzzle end of the canister, but these gases themselves still contribute to the overall noise of the muzzle report. A limited number of patents have attempted to make use of the physical phenomenon of destructive interference in order to reduce the volume of noise of a firearm discharge, as in, for example, U.S. Pat. No. 4,907,488 to Seberger.

Destructive interference is demonstrated in FIGS. 1-4, with FIG. 1 showing a single source of sound 10, outputting a simple omni-directional soundwave being emitted from the source. Beneath the source, a representation 12 of the soundwave is shown as a sinusoidal wave being emitted from the source in the horizontal direction. However, upon introduction of multiple sound sources, such as shown in FIGS. 2-4, the interference of sound waves 14, 16 causes some soundwaves to cancel each other out, such as in regions 18, 20. The combination of two identical soundwaves being emitted from sources that are half of a wavelength apart are shown in FIGS. 2-3. The blurring along the horizontal axis of the sources, as well as a small angle forming a cone around that axis, is where the maximum destructive interference regions 18, 20 are located. A more complete diagram is shown below the sources in FIG. 3, in which the sinusoidal waves 22, 24 of both sources are represented as being emitted in the horizontal direction. As shown in FIG. 3, the peaks and valleys of the two waves 22, 24 align in such a way that, when summed, the soundwaves cancel out. The acute angles between the horizontal line and the dashed lines in FIG. 3 indicate the areas of best destructive interference Similar patterns of destructive interference occur with soundwaves 26 originating from multiple sources such as four sound sources 28 as shown in FIG. 4.

The previous designs for firearm sound suppressors in the prior art attempted to create this destructive interference internally, in the suppressor canister. This creates several issues. First, as the canister heats up during use, the internal air/gas temperature of the canister also rises. This changes the speed of the soundwaves and slowly causes a loss of efficiency in sound suppression as the wavelength of the destructive wave is brought out of phase with the primary wave. Second, different applications create different internal pressures within the canister, so that either a new suppressor is required for each application, or the design of the suppressor has to be averaged across the different pressures and therefore reduce the efficiency for any particular round. An added difficulty in utilizing destructive interference comes from the fact that the soundwaves created by typical mechanical uses of chemical combustion processes cover a wide band of frequencies. Destructive interference works best when the frequencies being canceled are either limited in range or very specific and distinct.

However, a proper design of the overboard ports can tune these frequencies down to a much narrower band, perhaps down to just a single frequency, and placement of multiple overboard ports may be utilized in such a way that the interference of soundwaves is caused external to the suppressor cannister. The simplest design is a combination of two in-phase and identical soundwaves being emitted from sources that are half of a wavelength apart, which facilitates destructive interference of the soundwaves along some axis. The peaks and valleys of the two soundwaves align in such a way that, when summed, the soundwaves cancel out. Patterns of destructive interference can occur, such as in different patterns, with soundwaves originating from multiple sources such as four sound sources.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention includes the use of a sound suppressor that quiets the sound of chemical combustion processes by directing exhaust gases created by the combustion through two or more ports, with such ports to be positioned and shaped in such a way that the resulting soundwaves emanating from adjacent/grouped ports destructively interfere with each other.

The present invention also includes the use of one or more overboard ports on a sound suppressor, such that they receive their incoming air pressure from combustion exhaust gases at different times, so that the soundwaves produced and emanating from the ports are out of phase with each other.

The present invention also includes the positioning of two or more ports on a sound suppressor, so that, as the pressure waves from chemical combustion exhaust travel, they arrive at adjacent ports at different times, the soundwaves produced and emanating from the ports are out of phase with each other relative to time, facilitating the effects described above.

The present invention also includes the use of channels, of varying lengths and shapes, within the sound suppressor to delay the arrival of pressure waves and incoming gas from the propellant discharge to the ports, thus facilitating the effects described above.

The present invention also includes the use of one or more whistles that utilize the discharge gases of combustion process as their input flow source, with the purpose of tuning the frequency of the soundwave emitted by the discharge gases to a specific pitch.

The present invention also includes the use of one or more whistles as described above that are tuned above and beyond the range of hearing, by man or animal, for the purposes of reducing the audible effects of a combustion process.

The present invention also includes the use of two or more whistles as described above that are positioned in such a way to cause the soundwaves produced by one whistle in a pair/group to arrive at the position of another whistle in the same pair/group out of phase with the latter whistle's soundwave creating the overall effect of destructive interference.

The present invention also includes the use of one or more whistles as described above, attached to a sound suppressor, that receive their incoming air pressure from the discharge gas of a chemical combustion at different times, so as to produce soundwaves that are out of phase with each other with respect to time, creating the effect of destructive interference.

The present invention also includes the positioning of two or more whistles on a sound suppressor, so that, as the pressure waves from the discharge travel, they arrive at different whistles at different times, causing pairs/groups of whistles to produce soundwaves that are out of phase with each other relative to time, creating the effect of destructive interference.

The present invention also includes the use of internal channels, baffles, or obstacles to delay the arrival of pressure waves from the propellant discharge to the whistles, thus facilitating the effects described above.

The present invention also includes the combined use of the techniques outlined above, with the overall effect being that some or all of the soundwaves produced by one or more of the whistles destructively interfere with the soundwaves of one or more of the others.

The present invention also includes the use of three or more pairs/groups of whistles, utilizing the techniques described above in such a way that a group of one or more whistles destructively interfere with the primary frequencies of a second group of one or more of the other whistles, while a third group of one or more whistles destructively interfere with secondary (and tertiary and quaternary, etc. . . . ) harmonics of the primary frequency of one or more whistle.

The present invention also includes the use of any cover, sheath or obstruction adjacent and exterior to one or more of the ports mentioned above with the purpose of managing the direction of the escaping hot gas from a sound suppressor, a suppressor canister, and/or a firearm.

The present invention also includes the use of any cover, sheath or obstruction adjacent and/or exterior to one or more of the ports mentioned above with the purpose of directing the sound waves in a manner to increase the level and/or efficiency of the destructive interference.

The present invention also includes the use of any of the techniques described above and applied to any and all projectile weapons such as artillery units, cannons, pistols, rifles, etc.

The present invention also includes the use of any of the techniques described above and applied to the barrel, chamber, or any other part integral to a projectile weapon, firearm, firearm accessory, or firearm suppressor, positioned in such a way to result in destructive interference of the resulting pressure and sound waves caused by the use of such weapons.

The present invention also includes the use of any of the techniques described above and applied to any internal combustion engine of devices in a manner to reduce noise emanating from the engine. Such devices include ATV's, automobiles, trucks, trains, generators, boat engines, and airplane engines.

The present invention also includes the use of pairs or groups of overboard ports or orifices to vent the discharge gases. Each pair or group of ports or orifices is positioned in such a way that the soundwaves produced at each vent destructively interfere with one or more of the other soundwaves from the other ports. The present invention uses two methods to employ this phenomenon.

First, by utilizing an arrangement of channels or obstacles to delay the pressure wave from contacting one of two collocated ports, such obstructions delay the soundwave of one port so that it is out of phase with the other port's soundwave with respect to time.

Second, by placing the ports so that they produce soundwaves that are in phase with respect to time and placing the ports half of a wavelength apart from each other, there is a line in which the two waves come together and destructively interfere with each other. This line is congruent to the line between the two ports. For firearms suppressor variants of the present invention, arranging the ports so that this line is also congruent to the line between shooter and target will cause the destructive interference to render the weapon quieter to both the shooter and targets in the line of fire of the weapon.

The present invention includes the use of two or more overboard ports for the release of combustion exhaust gases in a sound suppressor, positioned in such a way that the gas escaping from these ports causes destructive interference of the resulting pressure and sound waves.

The present invention also includes the positioning of two or more overboard ports on a sound suppressor, so that, as the pressure waves from the discharge travel toward the ports, they arrive at the ports at different times, with the soundwaves produced and emanating from the ports being out of phase with each other relative to time, facilitating the destructive interference effect described herein.

The present invention further includes the use of one or more overboard ports on a suppressor or firearm, that receive their incoming air pressure from the discharge propellant at different times, so that the soundwaves produced and emanating from the ports are out of phase with each other at the moment of propagation from their respective sources.

The present invention further includes the use of channels of varying lengths and shapes to delay the arrival of pressure waves and incoming gas from the propellant discharge to the ports, thus facilitating the destructive interference effect described herein.

The present invention also includes the use of one or more whistles that utilize the discharge gases of chemical combustion as their source, with the purpose of tuning the frequency of the soundwave emitted by the discharge gases.

The present invention further includes the use of one or more whistles described herein that are tuned above and beyond the range of hearing by man or animal.

The present invention also includes the use of one or more whistles as described herein that are positioned in such a way to cause the soundwaves produced by one whistle in a pair/group to arrive at the position of another whistle in the same pair/group and out of phase with the latter whistle's soundwave.

The present invention further includes the use of one or more whistles as described herein, attached to the suppressor, that receive their incoming air pressure from the discharge combustion gases at different times, so as to produce soundwaves that are out of phase with each other with respect to time.

The present invention also includes the positioning of two or more whistles on a suppressor, so that, as the pressure waves from the discharge travel, they arrive at different whistles at different times, causing pairs/groups of whistles to produce soundwaves that are out of phase with each other relative to time facilitating the destructive interference effect described herein.

The present invention further includes the use of a channel, baffles or obstacles to delay the arrival of pressure waves from the combustion to the whistles, thus facilitating the destructive interference effect described herein.

The present invention also includes the combined use of the techniques described herein, with the overall effect being that some or all of the soundwaves produced by one or more of the whistles destructively interfere with the soundwaves of one or more of the others.

The present invention also includes the use of two or more overboard ports in the barrel, chamber or any other part integral to a firearm, positioned and designed in such a way that the discharge gas (created by the ignition of the propellant) escaping from these ports causes destructive interference of the resulting pressure and sound waves.

The present invention also includes the use of two or more overboard ports in the exhaust flow of an internal combustion engine, positioned and designed in such a way that the discharge gas, created by the ignition of the fuel, escaping from these ports causes destructive interference of the resulting pressure and sound waves.

In one embodiment, the present invention includes a sound suppressor comprising: a housing for receiving a gas from a device, the housing including: a plurality of ports for operating as whistles to suppress sound produced by the gas using destructive interference of the sound. The plurality of ports are at least partially out of phase with respect to time to create the destructive interference. The gas is generated by combustion in the device. The device is selected from a firearm, an artillery unit, a cannon, a pistol, and a rifle. Alternatively, the device is selected from an all-terrain vehicle (ATV), an automobile, a truck, a train, a generator, a boat engine, and an airplane engine. The plurality of ports are configured to be tuned to a predetermined frequency. The housing further includes: a baffle to delay a pressure wave of the gas from arriving at a first port, thereby causing the destructive interference. At least a pair of ports are positioned apart by half of a predetermined wavelength, thereby causing the destructive interference.

In another embodiment, the present invention includes a sound suppressor comprising: a housing including: an inlet for receiving a gas from a device; and a plurality of ports connected to the inlet for operating as whistles to suppress sound produced by the gas using destructive interference of the sound. The plurality of ports are at least partially out of phase with respect to time to create the destructive interference. The gas is generated by combustion in the device. The device is selected from a firearm, an artillery unit, a cannon, a pistol, and a rifle. Alternatively, the device is selected from an all-terrain vehicle (ATV), an automobile, a truck, a train, a generator, a boat engine, and an airplane engine. The plurality of ports are configured to be tuned to a predetermined frequency. The housing further includes: a baffle to delay a pressure wave of the gas from arriving at a first port, thereby causing the destructive interference. At least a pair of ports are positioned apart by half of a predetermined wavelength, thereby causing the destructive interference.

In a further embodiment, the present invention includes a method for suppressing sound from a device comprising: receiving, at a housing, a gas from the device; directing the gas to a plurality of ports in the housing, with the plurality of ports operating as whistles; and using destructive interference of sound generated by the gas, thereby suppressing the sound. The method further comprises generating the gas by combustion in the device. The method further comprises directing the gas to a baffle; and delaying a pressure wave of the gas from arriving at a first port, thereby causing the destructive interference. The method further comprises positioning at least a pair of ports apart by half of a predetermined wavelength, thereby causing the destructive interference.

BRIEF DESCRIPTION OF DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
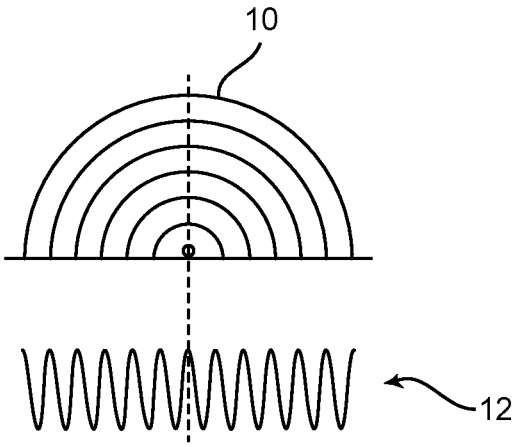
FIG. 1 (PRIOR ART)
FIG. 1 is an illustration of a sound wave from a single source of sound in the prior art.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION

Certain terminology is used in the following description for convenience only and is not limiting. The article "a" is intended to include one or more items, and where only one item is intended the term "one" or similar language is used. Additionally, to assist in the description of the present invention, words such as top, bottom, side, upper, lower, front, rear, inner, outer, right and left may be used to describe the accompanying figures. The terminology includes the words above specifically mentioned, derivatives thereof, and words of similar import.

Figure 5:
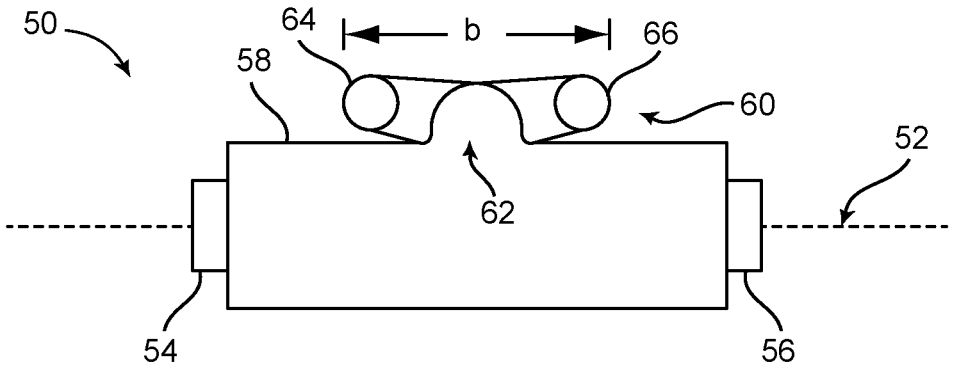
FIG. 5 is a side cross-sectional view of a sound suppressor of the present invention.
Figure 6:
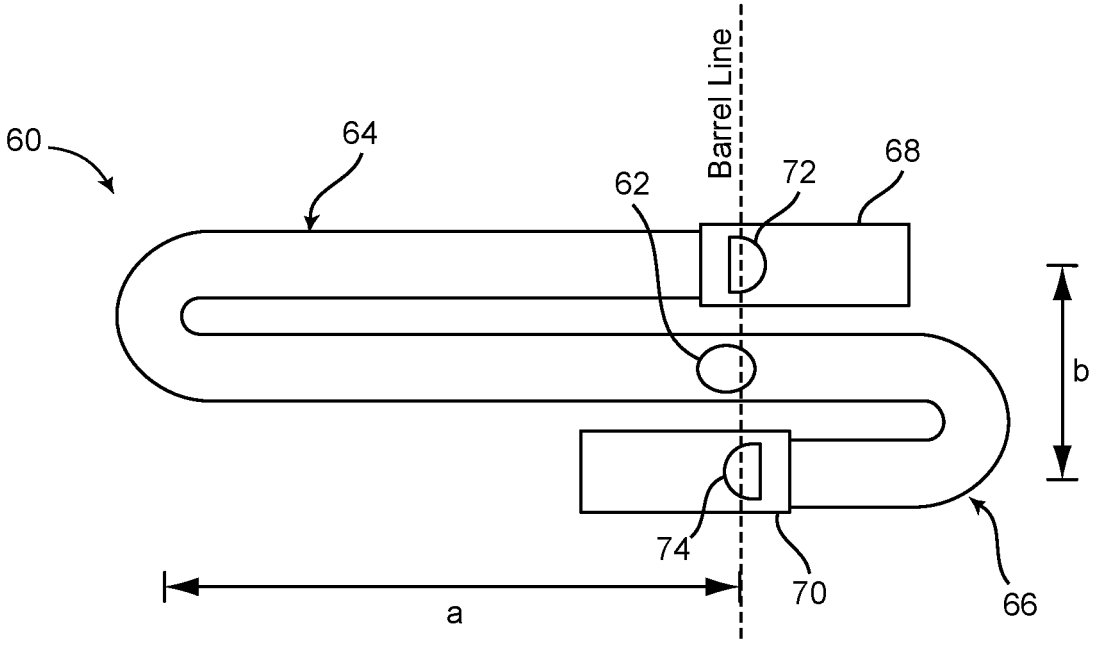
FIG. 6 is a top cross-sectional view of a whistle mechanism of the sound suppressor of FIG. 5.
Figure 7:
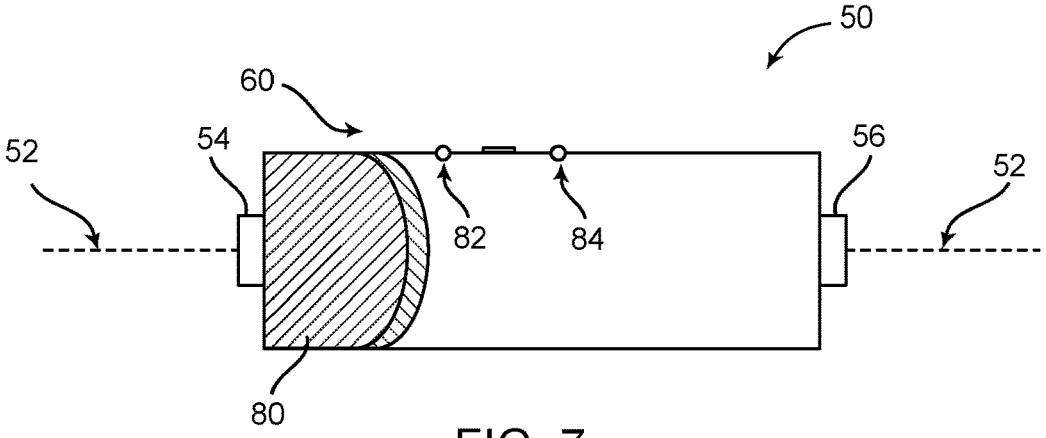
FIGS. 7-11 are illustrations showing a progressive operation of the sound suppressor of the present invention.

FIG. 5 is a side cross-sectional view of a firearm sound suppressor 50 of the present invention, and FIG. 6 is a top cross-sectional view of a whistle mechanism of the firearm sound suppressor of FIG. 5, in which the longitudinal axis of the suppressor 50 is aligned with the axis 52 of the barrel of a firearm. The uprange end 54 of the suppressor 50 is attached to the barrel (not shown), and the projectile of the firearm exits from the downrange muzzle end 56. The whistle assembly 60 of the present invention is mounted to, for example, the top surface 58 of the suppressor 50, with a single port 62 as an inlet in the wall of the firearm sound suppressor 50 allows discharge gases into the channels 64, 66 as a housing leading to the whistles 68, 70, having vent orifices 72, 74, respectively. The channels 64, 66 can be manufactured to different lengths, which changes the phase of the soundwaves produced by the whistles 68, 70 with respect to time. By varying distance "a", the phase of the downrange whistle 70 can be varied compared to the uprange whistle 68 with respect to time. By adjusting distance "b", which is the distance between the orifices 72, 74 of the whistles, the phase that the soundwave of the downrange whistle 70 has when it arrives at the location of the uprange whistle 68 can be adjusted. It is understood that the whistles 68, 70 may be embodied as any instrument that creates sound by causing vibrations in a moving column of gas, including, but not limited to: aerostatic generators, aerophones, Galton whistles, Hartmann whistles, pyrophones, plain whistles, resonators, organ whistles, chime whistles, flutes, pipes, Bangham whistles, toroidal whistles, Levavasseur whistles, vortex whistles, Helmholtz resonators, Helmholtz whistles, and Hooter whistles.

Preferably, varying distance a is performed for delaying the wave from one port or whistle to the next, so that the whistles are partially out of phase with respect to time, and varying distance b between the whistles orifices 72, 74 to compensate for the remaining phase difference in order to create the desired destructive interference.

As noted herein, the sound/pressure waves from a firearm discharge cover a wide array of frequencies. Thus, getting the bulk of such frequencies to cancel presents a problem. In order to deal with the wide band of frequencies created by the discharge gases, the vent orifices 72, 74 of the whistles 68, 70, as well as the whistles themselves are shaped and dimensioned to produce narrow bands of frequencies. The arrangements and spacing between pairs or sets of vent orifices 72, 74 is then determined and fabricated according to the frequency produced by the gases escaping the whistles 68, 70. This allows the destructive interference to take place outside the suppressor canister 50.

The optimal way of a shaped orifice for creating a stable frequency is that of a whistle or flute. Accordingly, the present invention employs the whistles 68, 70 at each overboard port 62 which draws their incoming air from the discharge gases of the firearm. Tuning the pitch of the escaping gases using the whistles 68, 70 has many benefits. First, porting the discharge gases through whistles makes it easier to control the frequency of the soundwaves of the discharge gas, which in turn makes it easier to employ destructive interference. Second, since different selections of ammunition can create different pressures within the suppressor canister 50, the additional pressure applied to the incoming air of a whistle has the limited effect of changing only the amplitude or loudness of the sound emitted from the whistle, while a change in frequency or pitch is negligible.

Third, the whistles 68, 70 can be tuned to ultrasonic frequencies above and beyond the range of hearing of humans and even animals, thus reducing the audibility of the pressure waves produced by the discharge. Fourth, higher frequency soundwaves dissipate at a quicker rate as they travel through the atmosphere compared to lower frequency waves. Thus, the whistles 68, 70 may be employed with suppressors 50 of firearms in a military-style application to mask the position of a long-range shooter.

Accordingly, the arrangement of whistles 68, 70 form a "tuned pair" of two overboard whistle orifices 72, 74 of the whistles 68, 70 in line with themselves as shown in FIG. 6. Although the destructive interference only takes place in a narrow cone of angles centered around the line of the whistle orifices 72, 74, by placing the line parallel or even aligned with the axis 52 of the barrel, both the shooter and the target is within those cones. In this way, the firearm is quieter to both shooter and target while still being audible to others. This has the benefit of allowing hunters and recreational shooters to reduce the harm done to their ears by the noise of the firearm discharge while eliminating any concerns about a suppressor being used to conceal the commission of crimes, as the noise is still audible to others.

FIGS. 7-11 show progressive operation of the firearm sound suppressor 50 of the present invention. For the simplest example, with two whistles 82, 84, that destructively interfere at their primary frequency, FIGS. 7-11 show the pressure wave 80, originating from the firearms discharge, traveling along the longitudinal length of the suppressor 50.

Figure 8:
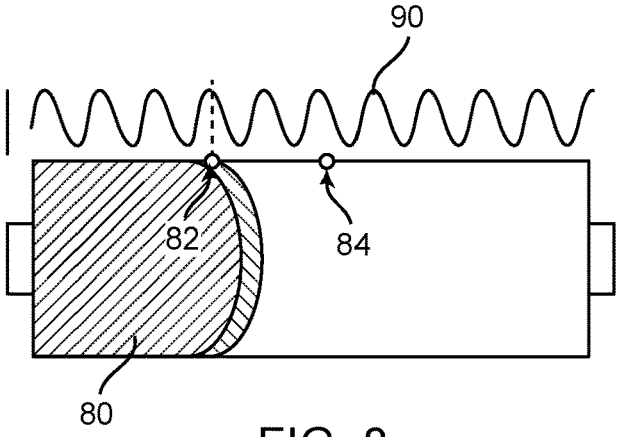
Figure 9:
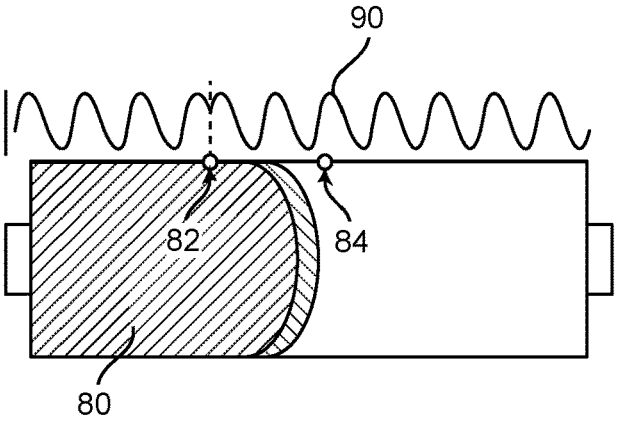

Referring to FIGS. 7-11, the pressure wave 80 of the discharge gases moves towards the muzzle end 56 of the suppressor 50 and comes into contact with the uprange whistle 82, and the uprange whistle 82 begins to produce soundwaves with its primary frequency represented by the sinusoidal wave 90 in FIG. 8. After a duration of time, as shown in FIG. 9, the pressure wave 80 has moved farther downrange, but not far enough to have come into contact with the downrange whistle 84. The soundwave from the whistle orifice 82 emits symmetrically along the longitudinal axis, as shown in FIG. 1, and is represented by the sinusoidal wave 90 in FIG. 9, since there are no additional soundwaves to interfere with.

Figure 2:
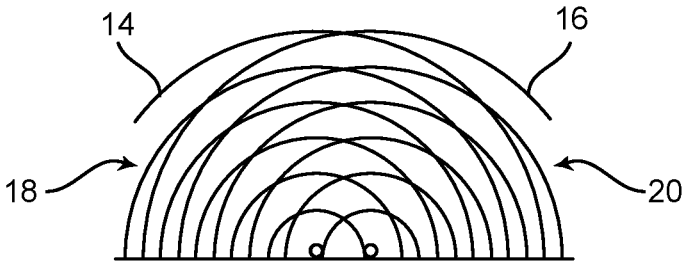
FIG. 2 (PRIOR ART)
FIGS. 2-4 are illustrations of sound waves with destructive interference from multiple sound sources in the prior art.
Figure 3:
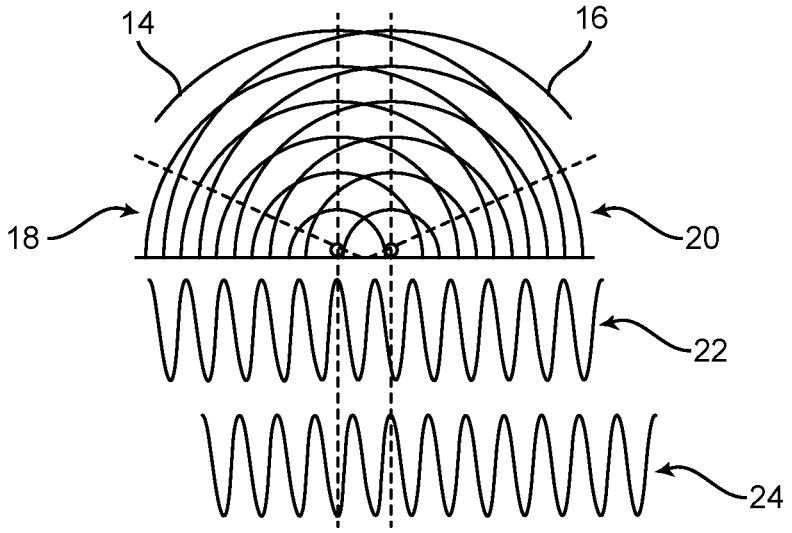
FIG. 3 (PRIOR ART)
Figure 4:
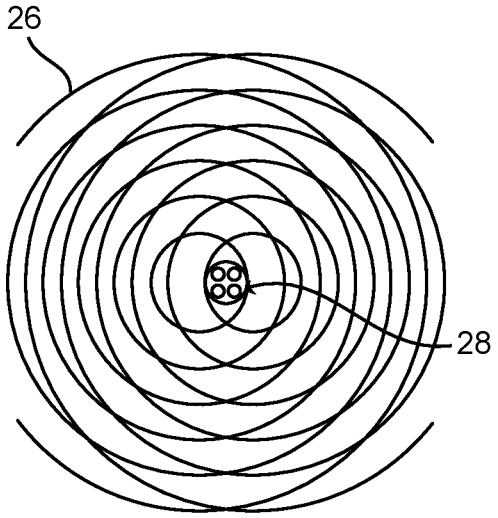
FIG. 4 (PRIOR ART)
Figure 10:
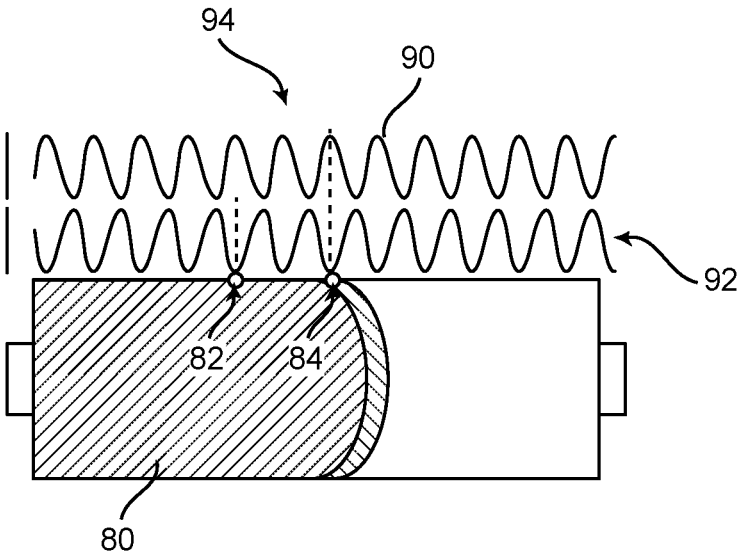

Later, the pressure wave 80 comes into contact with the downrange whistle 84, as shown in FIG. 10, such that the whistle 84 emits soundwaves represented in FIG. 10 by the sinusoidal wave 92. The spacing of the orifices 82, 84 of the whistles and the delay between the arrival of the pressure wave 80 from one whistle to the next are such that, once the two whistles 82, 84 begin emitting sound, the soundwaves from the whistles are out of phase, as shown in FIG. 2, and represented by the out-of-phase sinusoidal waves 90, 92 in FIG. 10. Such out-of-phase soundwaves destructively interfere, resulting in less noise from the muzzle report.

Figure 11:
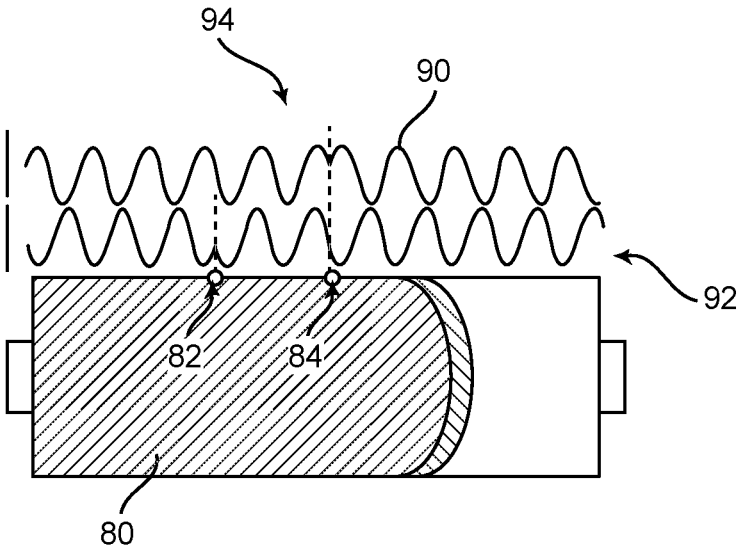

As time continues, both soundwaves from the whistles 82, 84 continue to emit symmetrically from their respective sources, as shown in FIG. 11, and destructively interfere. Despite a "cacophony" zone 94 between the two whistles 82, 84, as shown in FIGS. 10-11, the area beyond the whistle orifices 82, 84 has the sum of the two waves cancel out due to destructive interference, as shown in FIG. 2. Accordingly, the suppression of sounds by the suppressor 50 having whistle orifices 82, 84 as in the present invention is more effective than suppressors in the prior art which do not employ whistles.

Figure 12:
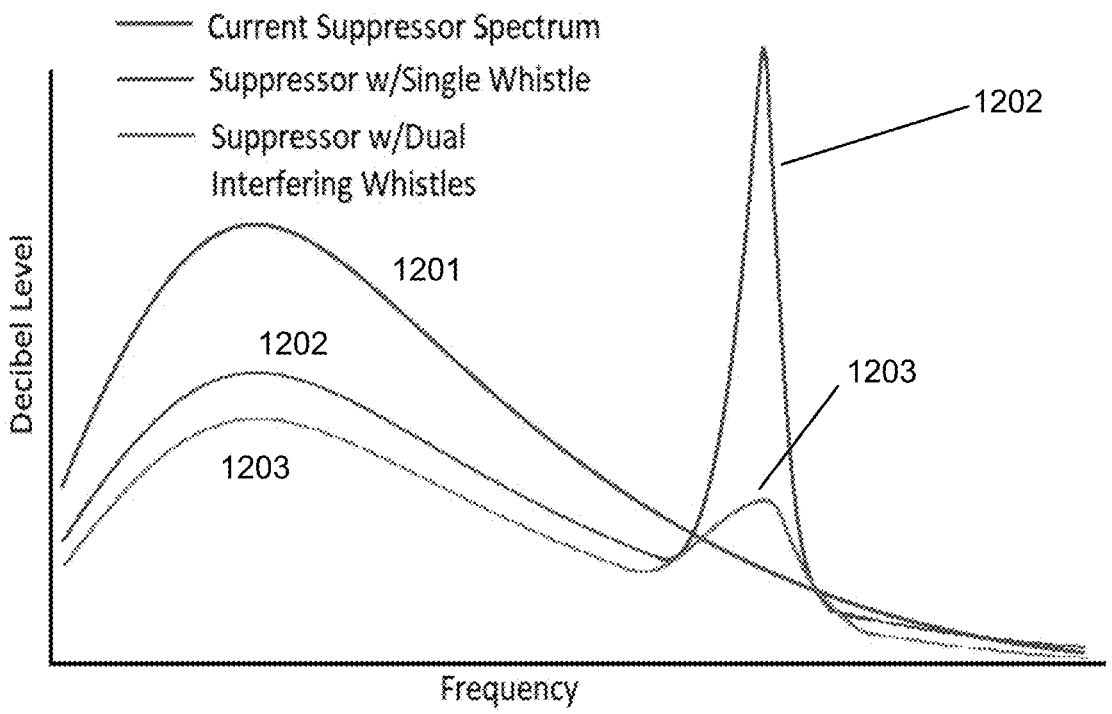
FIG. 12 is a graph of decibel levels of sound vs. frequency of sound suppressors of the present invention and of the prior art.

FIG. 12 illustrates the sound levels, in decibels, as a function of frequency, from suppressors in the prior art 1201 compared to sound levels from a suppressor with a single whistle 1202 and with dual interfering whistles 1203 as in the present invention. The sound levels of suppressors employing one or more whistles 1202, 1203 is generally lower over a wide range of frequencies compared to suppressors in the prior art which lack whistles 1201. Note that, at relatively high frequencies, use of a single whistle has a very large spike in sound levels 1202, while use of dual interfering whistles lacks such a large spike in sound levels 1203. In addition, by creating the destructive interference external to the suppressor cannister, the soundwaves are not subject to the changes of pressure/temperature inside the cannister. It is seen that the suppressor of the present invention reduces noise by 20-30% compared with the suppressors of the prior art. With the present invention, it could be possible for a user to shoot a firearm without hearing protection.

In an alternative embodiment, multiple "tuned pairs" of whistles may be used, with each whistle within a pair working to destructively interfere with the sound waves of its tuned partner. The more gases that are discharged through the tuned whistles, the less discharge gas that exits through the muzzle in a much louder fashion. In a further alternative embodiment, different geometries and layouts can be utilized, i.e. instead of a "tuned pair", whistles might be laid out in a "tuned triplet" where a larger whistle, at the apex of an isosceles triangle, is canceled out by two smaller tuned whistles at the base of the triangle. The spacing of the smaller whistles at the base of the isosceles triangle could be such that the two smaller whistles also destructively interfere with each other. This layout, properly employed, could create destructive interference not only in line with the line of fire, but also laterally. Further, a square layout, or in fact any polygonal arrangement of whistles could be utilized, such as four whistles with one at each corner. Each whistle is out of phase with the whistles at the adjacent corners, thus creating destructive interference in two different directions.

Figure 13:
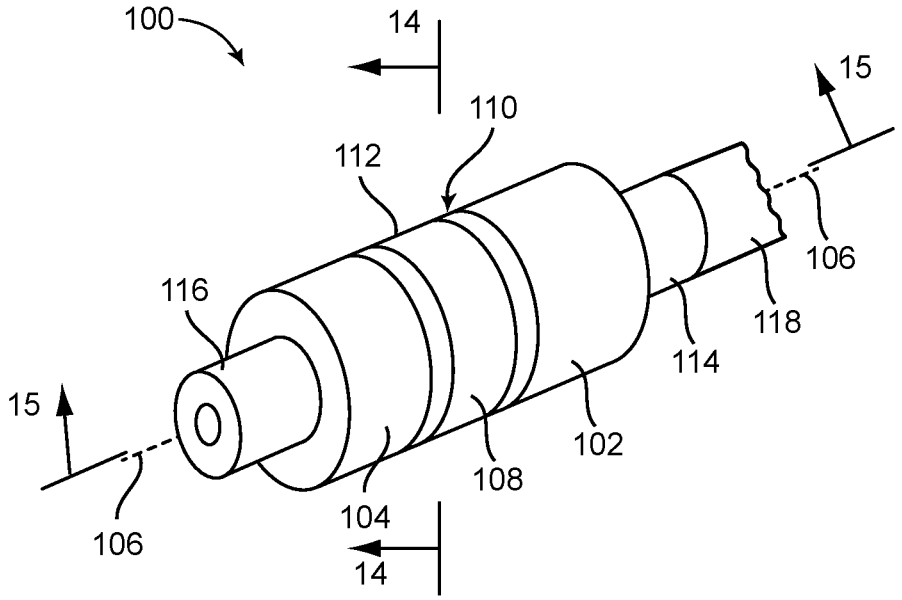
FIG. 13 is a front side top perspective view of an alternative embodiment of the sound suppressor of the present invention.

In another alternative embodiment of the firearm sound suppressor of the present invention, shown in FIG. 13, destructive interference is created through paired toroidal whistles. An example of a toroidal whistle in the prior art is described in U.S. Pat. No. 4,429,656 to Weisenberger.

In this alternative embodiment, instead of trying to create a multi-tone whistle with maximum volume, exhaust gases are channeled through a suppressor 100 having one or more paired toroidal whistles 102, 104 in a series configuration in such a fashion that their soundwaves destructively interfere with each other along the shooter/target line 106. The uprange toroidal whistle 102 and the downrange toroidal whistle 104 are joined by a center piece 108, and have whistle ports 110, 112, respectively, and end pieces 114, 116, respectively. The shooter-side barrel end piece 114 is coupled to the barrel 118 of the firearm, and the projectile of the firearm exits through the target-side muzzle end piece 116.

Figure 14:
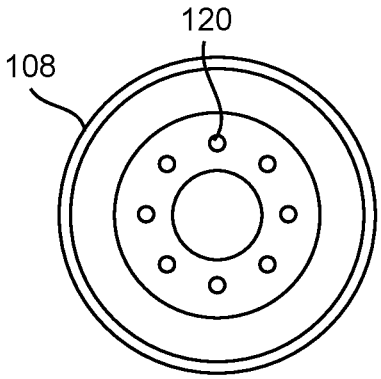
FIG. 14 is a front cross-sectional view of the sound suppressor of FIG. 13 along lines 14-14.

The suppressor 100 may have a multi-piece design in which the center piece 108, the whistles 102, 104, and the end pieces 114, 116 are formed separately, and are joined during the fabrication process to facilitate easy machining and manufacturing. As shown in the cross-sectional view of FIG. 14, the center piece 108 may have periodically embossed mounting faces which are complementary to the correspondingly oriented faces of the whistles 102, 104, and which allow support studs 120, such as rivets or screws, to secure the components 102, 104, 108 together. The support studs 120 can be positioned to firmly secure the components 102, 104, 108 together, without inhibiting the flow of discharge gases emanating from the interior of the suppressor 100.

Figure 15:
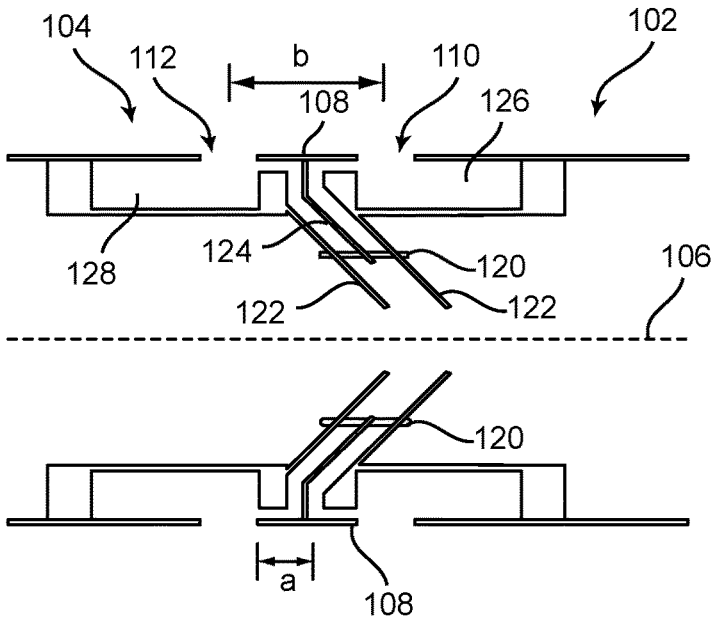
FIG. 15 is a side cross-sectional view of the whistle mechanism of the sound suppressor of FIG. 13 along lines 15-15.

As shown in FIG. 15, the center piece 108 has baffles 122, 124 which direct the discharge gases into the resonator cavities 126, 128 leading to the whistle ports 110, 112. The resonator cavities 126, 128 can be manufactured to different dimensions, which changes the frequencies of the soundwaves produced by the whistles. By varying distance "a", the gases reach the whistle cavities at different times, resulting in the phase of the downrange whistle port 112 being varied with respect to time compared to the uprange whistle port 110. By adjusting distance "b", which is the distance between the centers of the orifices of the ports 110, 112 of the whistles, the phase that the soundwave of the downrange whistle port 112 has when the soundwave arrives at the location of the uprange whistle port 110 can be adjusted. In an example embodiment, the distance b is one-half of the wavelength of the soundwave for initiating destructive interference.

Figure 16:
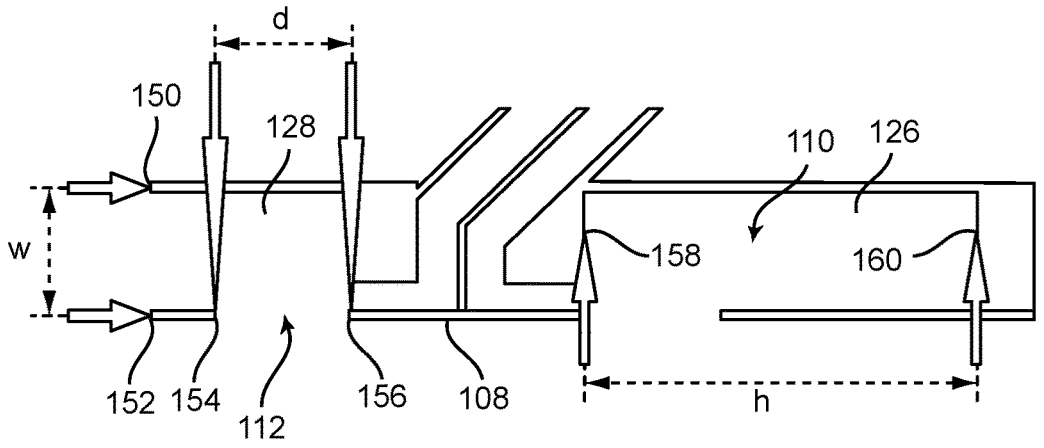

Referring to FIGS. 13 and 16, the width w of the resonator cavities 126, 128 is the dimension from the outer diameter of the inner cores forming the whistles 102, 104 to an inner diameter of the end pieces 114, 116; that is, between points 150, 152 in FIG. 16. In addition, the size d of each orifice 110, 112, extending between points 154, 156 in FIG. 16, is preferably about the same as the width w of the resonator cavities 126, 128. Referring again to FIG. 16, the height h of each whistle chamber or resonator cavity 126, 128 is the dimension from the edge of the whistle port to the back wall of the chamber; that is, from the edge of the lip, which is the mirror image of the point 154, to the surface 160 in FIG. 16. Preferably, the height-to-width ratio is about 3:1. The wavelength of each whistle 102, 104 is determined from the following equation: $\lambda=4(h+0.4w)$. For approximation purposes only, the height h of the chamber is about equal to $\lambda/4$.

Figure 17:
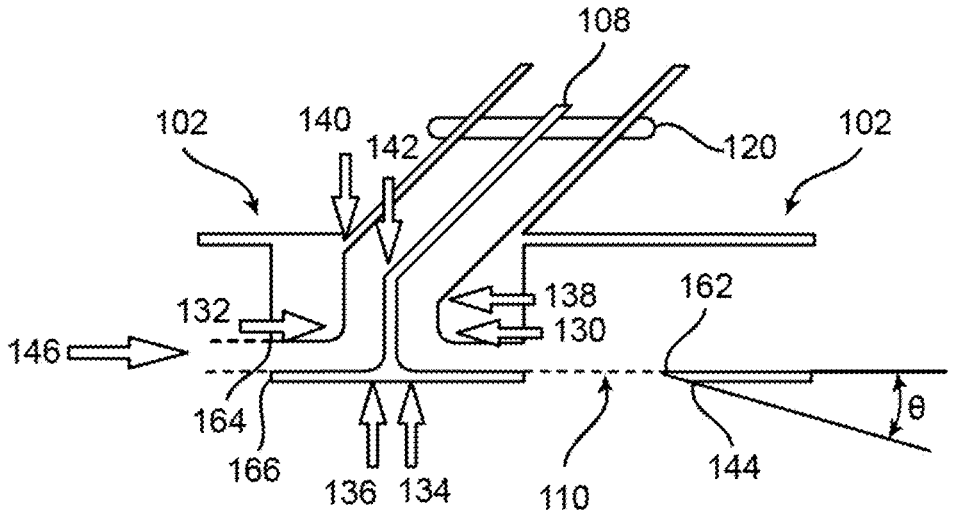
FIGS. 16-17 are cross-sectional views of the whistle mechanism of FIG. 15.

In another alternative embodiment, as shown in FIG. 17, the interior surfaces and/or corners 130, 132 of the whistle channels, respectively, are rounded to ensure that the escaping discharge gases have a relatively smooth airflow through the resonator cavities 126, 128 and use the full width of the gap between the points 164 and 166 in FIG. 17. Similarly, the interior surfaces and/or corners 134, 136 of the center piece 108 may be rounded for relatively smooth airflow. Additional corners or surfaces 138, 140, 142 of the components 102, 104, 108, respectively, may optionally be rounded and/or relatively smooth to improve the airflow of the discharge gases.

In addition, the orifices 110, 112 of the whistles 102, 104 may have an angular surface 144 extending from a point 162 in FIG. 17 and forming an angle θ in the range of about 13 degrees to about 17 degrees for improved generation of the soundwaves by the whistles 102, 104, with the angle θ preferably being about 15 degrees for optimal performance of the whistles 102, 104. Furthermore, referring to FIG. 13, the inner diameter of the center piece 108 is to be substantially equal to the inner diameter of the whistle cavities 126, 128. Also, referring to FIGS. 13 and 17, the size of the outer diameter of each whistle 102, 104 is less than the size of the inner diameter of the center piece 108, with the difference 146 between the outer diameter of each whistle 102, 104 and the inner diameter of the center piece 108; that is, from point 164 to point 166 in FIG. 17, being in the range of about 0.0575 inches to about 0.0675 inches, and a difference 146 of 0.0625 inches is an optimal value.

In a further alternative embodiment, the use of ports and whistle technology for causing destructive interference of sounds from a firearm, as described herein, may also be incorporated into the overall design of a firearm, with overboard ports located in the grooves of a rifled barrel. This eliminates the need for a bolt-on style suppressor that extends the length and moment arm of the barrel/firearm, and which makes the firearm more maneuverable in tight quarters and lighter for more comfortable carrying and firing. Other uses of the sound suppressor of the present invention are possible, including on a truck exhaust, diesel generators, two stroke yard equipment such as lawnmowers, etc.

As described herein and in connection with additional alternative embodiments illustrated in FIGS. 18-28, the present invention is a sound suppressor for use in firearms, internal combustion engines, and numerous other sound-generating devices and which includes a structure having a plurality of ports, openings, or orifices which function as whistles and which suppress sound from a source of the sound using destructive interference.

Preferably, a combination of varying distances between components is configured for delaying the wave from one port or whistle to the next, so that the whistles are partially out of phase with respect to time, and placing the orifices of the whistles a certain distance apart to compensate for the remaining phase difference in order to create the desired destructive interference.

As noted herein, the sound/pressure waves resulting from mechanical use of chemical combustion cover a wide array of frequencies. Thus, getting the bulk of such frequencies to cancel presents a problem. In order to deal with the wide band of frequencies created by the discharge gases, the gases are directed through whistles. The whistles themselves are shaped and dimensioned to produce narrow bands of frequencies. The arrangements and spacing between pairs or sets of vent orifices of the whistles are then determined and fabricated according to the frequency produced by the gases escaping the whistles so that the sound emanating from the whistles destructively interferes. This destructive interference takes place outside the suppressor canister.

The optimal way of a shaped orifice for creating a stable frequency is that of a whistle or flute. Accordingly, the present invention employs the whistles at each overboard port which draw their incoming air from the exhaust gases of the chemical combustion. Tuning the pitch of the escaping gases using the whistles has many benefits.

First, porting the discharge gases through whistles makes it easier to control the frequency of the soundwaves of the discharge gas, which in turn makes it easier to employ destructive interference.

Second, while different applications of the sound suppressor can create different pressures within the suppressor canister, the additional pressure applied to the incoming air of a whistle has the limited effect of changing only the amplitude or loudness of the sound emitted from the whistle, while a change in frequency or pitch is negligible. So long as pairs/groups of whistles are all similarly reduced in amplitude, the destructive interference is maintained since it is only a function of frequency and position.

Third, the whistles can be tuned to ultrasonic frequencies above and beyond the range of hearing of humans and even animals, thus reducing the audibility of the pressure waves produced by the discharge.

Fourth, higher frequency soundwaves do not penetrate surfaces and boundaries as well; they tend to reflect off of material surfaces rather than transmit through them. Thus, the whistles may be employed on the engines of suburban lawn equipment to reduce the noise experienced within their homes.

Figure 18:
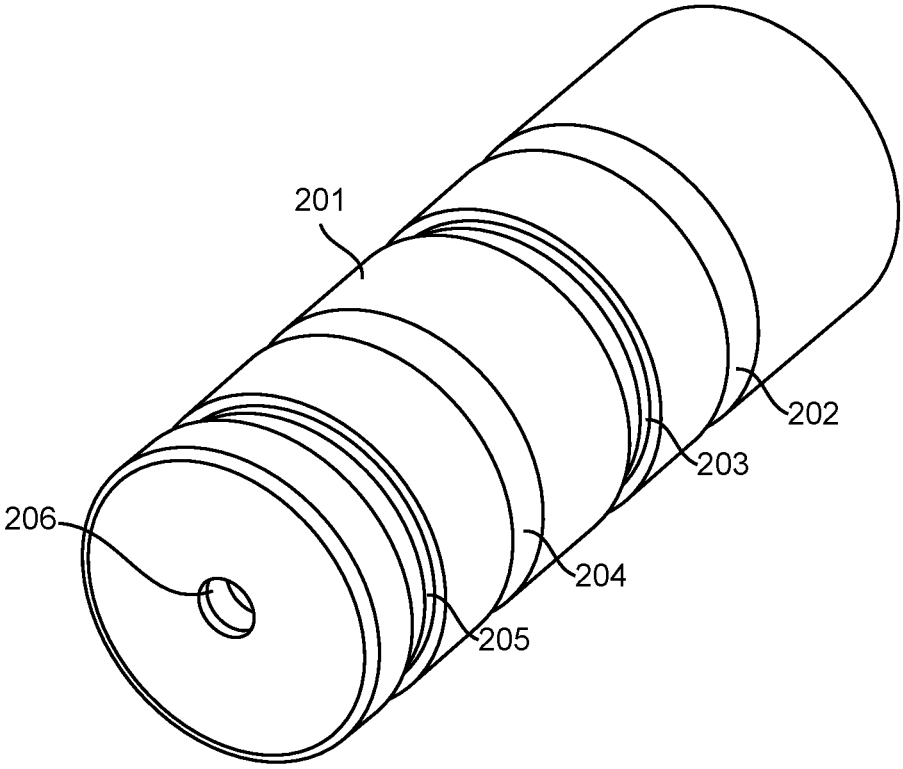
FIG. 18 illustrates a front top side perspective view of a sound suppressor of the present invention for use in firearms.

The arrangement of whistles should form a "tuned pair" of two overboard whistle orifices which are in line with themselves. Although the destructive interference only takes place in a narrow cone of angles centered around the line of the whistle orifices by placing the line parallel or even aligned with the axis of the barrel, both the shooter and the target is within those cones. In this way, the firearm is quieter to both shooter and target while still being audible to others. This has the benefit of allowing hunters and recreational shooters to reduce the harm done to their ears by the noise of the firearm discharge while eliminating any concerns about a suppressor being FIG. 18 illustrates a front top side perspective view of a sound suppressor of the present invention for use in firearms, with the sound suppressor embodied in a firearms suppressor canister 201 having pairs of whistles for suppressing sound from a firearm. A first pair of whistle includes ports 202, 203, and a second pair of whistles includes ports 204, 205. The orifice 206 at the front of the canister 201 is the opening through which a firearm projectile exits from the canister 201.

Figure 19:
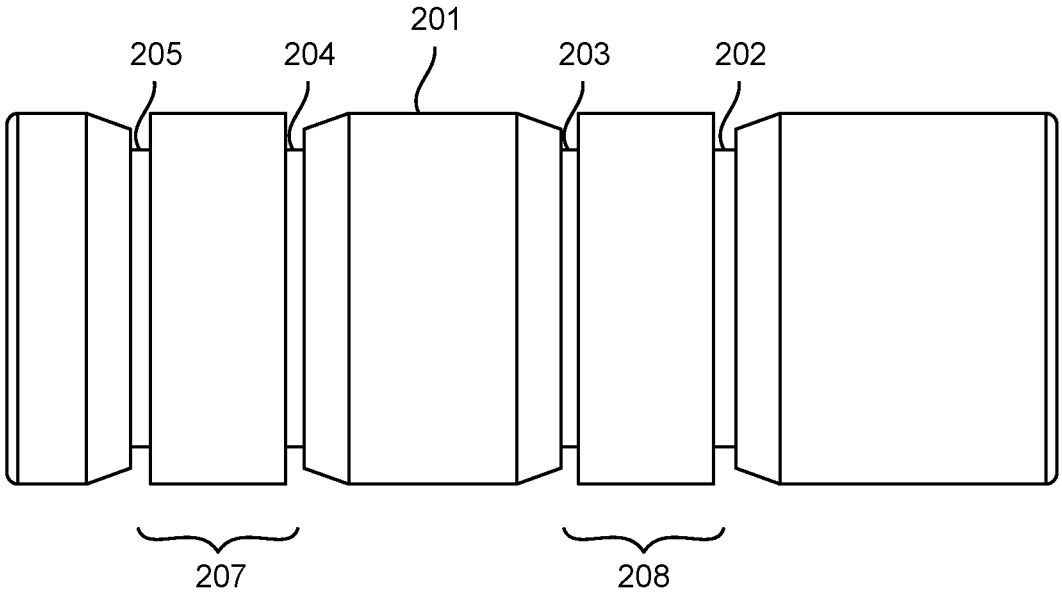
FIG. 19 illustrates a side plan view of the sound suppressor of FIG. 18.

FIG. 19 illustrates a side plan view of the sound suppressor of FIG. 18, in which the first pair of whistles having ports 202, 203 has a length 208 which is a half-wavelength of the sound created by the whistles, and in which the second pair of whistles having ports 204, 205 has a length 207 which is also a half-wavelength of the sound created by the whistles.

Figure 20:
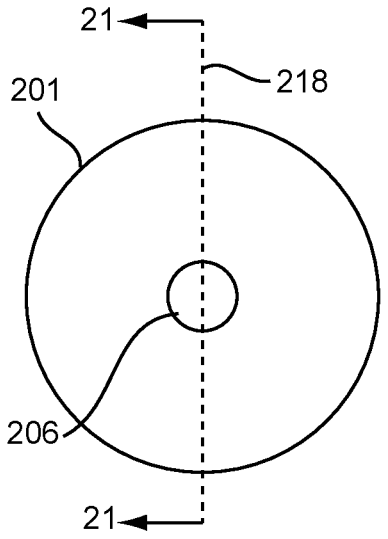
FIG. 20 illustrates a front plan view of the muzzle end of the sound suppressor of FIG. 18.
Figure 21:
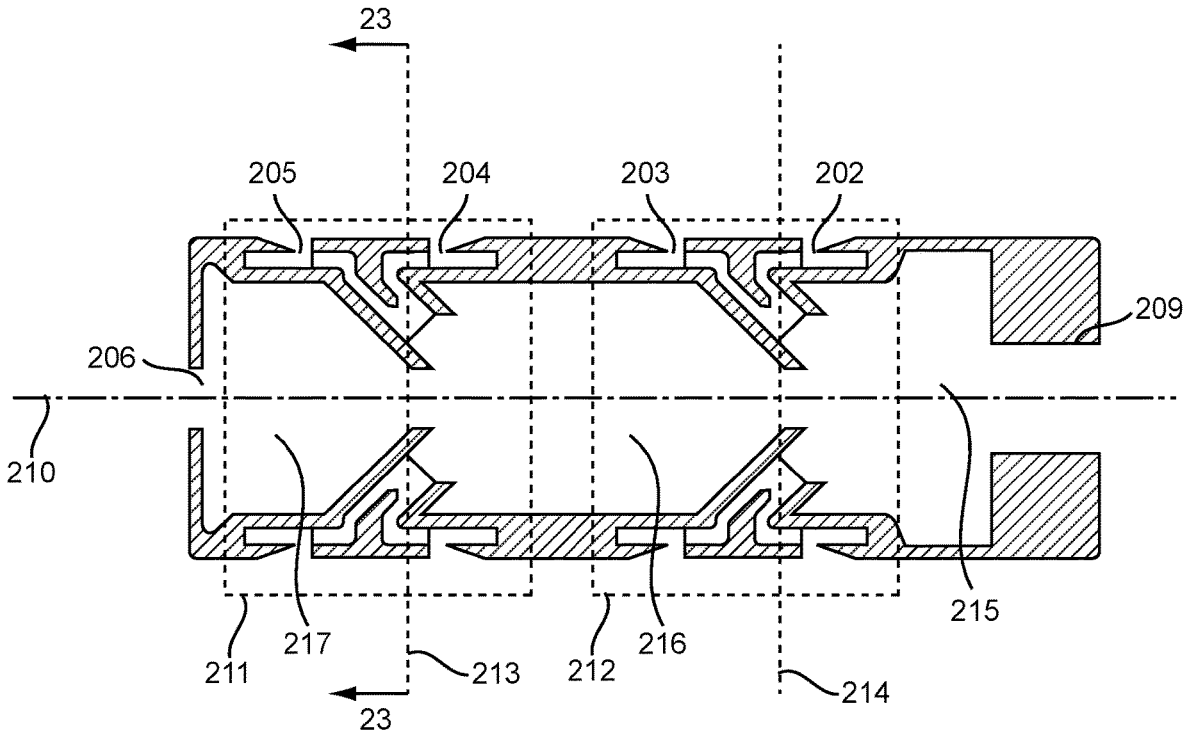
FIG. 21 illustrates a side cross-sectional view of the sound suppressor of FIG. 18 along lines 21-21 in FIG. 20.

FIG. 20 illustrates a front plan view of the muzzle end of the sound suppressor of FIG. 18, having a plane 218 of symmetry which divides the canister 201. FIG. 21 illustrates a side cross-sectional view of the sound suppressor of FIG. 18 along lines 21-21 in FIG. 20, by which the suppressor is cylindrically symmetrical about a central axis 210. Accordingly, except for line 222, many of the lines and corners in FIG. 21 which are above and below the central axis 210 are depicted as mirror images of each other due to such lines and corners being the same edge or point. The suppressor is for use in firearms, and so includes an orifice that, for example, is threaded to screw onto or otherwise is attached to the end of a barrel of a firearm. The region 212 in FIG. 21 is a rectangular area which bounds the first pair of whistles, while the region 211 in FIG. 21 is a rectangular area which bounds the second pair of whistles. Because the pairs of whistles may be substantially identical, the cross-sectional views of regions 211, 212 are, in turn, substantially identical.

Figure 23:
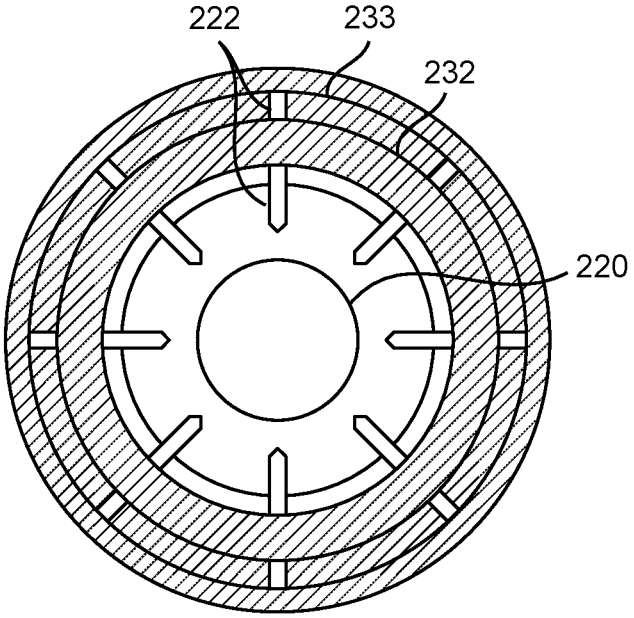
FIG. 23 illustrates a cross-sectional view of the sound suppressor of FIG. 21 along lines 23-23 in FIG. 21.

Vertical lines 213, 214 illustrate cross-sectional cutaway regions which are identical and shown in FIG. 23. Furthermore, in the suppressor in FIG. 21, an entrance cavity 215 receives the projectile and accompanying discharge gas from the muzzle of the firearm, a secondary cavity 216 receives the projectile and accompanying discharge gas passing through the suppressor, and an exit cavity 217 receives the projectile and accompanying discharge gas passing through and exiting the suppressor via the orifice 206.

Figure 22:
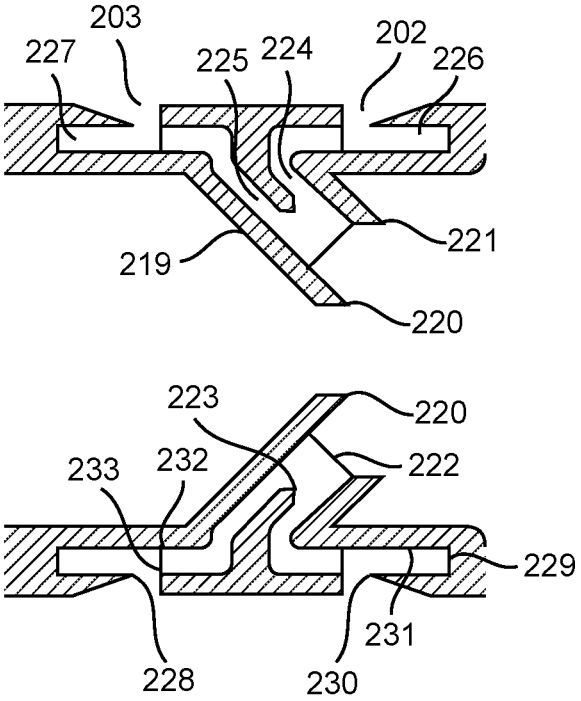
FIG. 22 illustrates an enlarged portion of the side cutaway view of FIG. 21.

FIG. 22 illustrates an enlarged portion of the side cutaway view of FIG. 21, as outlined by the rectangular regions 211, 212 of FIG. 21. As in the prior art, the suppressor of the present invention includes conical-shaped baffles 219 to capture and slow exhaust gases, with a circular interior edge 220. While some of the exhaust gas from the muzzle blast travels through the circle formed by the interior edge 220, some of the exhaust gas also travels through the concentric ring created by the circular edges 220, 221. The exhaust gas then travels between the two conical-shaped baffles 219, 221 and is initially separated by the radial supports 222, which are walls that extend radially from the central axis 210 but which allow the exhaust gas to flow between the supports 222. The supports 222 serve to connect and to support the sections of the suppressor, such as shown in FIG. 23.

After the exhaust gas is divided by the radial supports 222, the gas is again divided by a flow separator 223, which separates and guides the gas flow into two separate channels 224, 225. The channels 224, 225 are dimensioned and shaped to cause the flow out of the ports 202, 203 to be approximately equal in volume and pressure. The gas from the channel 224 then flows into a cavity 226 of the first whistle, and the gas from the channel 225 then flows into a cavity 227 of the second whistle.

The dimensions of the cavities 226, 227 of both whistles are preferably identical. Each cavity 226, 227 has a rectangular cross-section with a height being from the chamfered edge 228, 230, respectively, to a back wall 229 of the cavity 226, 227. The width of each cavity 226, 227 is the distance of an inner diameter wall 231 of the cavity to an outer diameter wall of the cavity, which is equivalent to the normal distance from the wall 231 to the edge 230. After the gas cavitates in the whistle cavities 226, 227, the exhaust gas flows through the orifices 202, 203, respectively, creating a distinct whistle pitch. The edge 230 is preferably chamfered to provide the most laminar flow out of the whistle, and to best facilitate the whistle effect.

The frequency of the whistle is, for the most part, determined by the dimensions of the cavity 226, 227 and the exit orifice 202, 203, so the dimensions of the whistle cavities 226, 227, as well as the position of the orifices 202, 203 relative to each other, are all carefully coordinated and set so that the dimension 208 is the length of one-half wavelength of the whistle tone created by the whistle cavities 226, 227. The whistles must produce the same frequency pitch at the same amplitude to have the maximal destructive interference effect.

Because the pair of whistles destructively interferes with itself, there is no theoretical requirement for a second pair of whistles. However, given that the gases traveling through the circle created by the conical-shaped baffle 219 and entering the secondary cavity 216 likely still has excessive temperatures and pressures, additional pairs of whistles may be able to provide additional benefit to the reduction of the firearm sound signature.

The second pair of whistles is essentially identical in setup to the first pair of whistles. However, because there is less incoming gas flow to the secondary cavity 216, channels 224, 225 on the second pair of whistles may have different shapes and dimensions relative to the channels 226, 227 on the first pair of whistles. Because each pair of whistles acts to destructively interfere with itself, there is also no requirement that the cavities of the first pair of whistles match the cavities of the second pair. There's no theoretical limit to how many pairs of whistles may be added to form a suppressor, although eventually depending on the chamber pressure of the firearm, the gas flow is too minimal to effectively create a whistling effect.

FIG. 23 illustrates a cross-sectional view of the sound suppressor of FIG. 21 along lines 23-23 in FIG. 21, with a circular edge 220 created by the conical baffle 219 shown in FIG. 21. The orifice has an interior diameter 232 leading into the whistle cavity, and an outer diameter 233 of the orifice leading into the whistle cavity. The suppressor has a plurality of radial supports 222, such as in eight radial-spaced locations, which extend all the way to the outer diameter 233 of the suppressor canister. These supports 222 may be linear shaped, but in alternative embodiments the supports 222 need not necessarily be linear. For example, in one alternative embodiment, supports that radiate from the center in a spiral shape may be better at smoothing the gas flow, providing a more even and better flow through the whistles.

Figure 24:
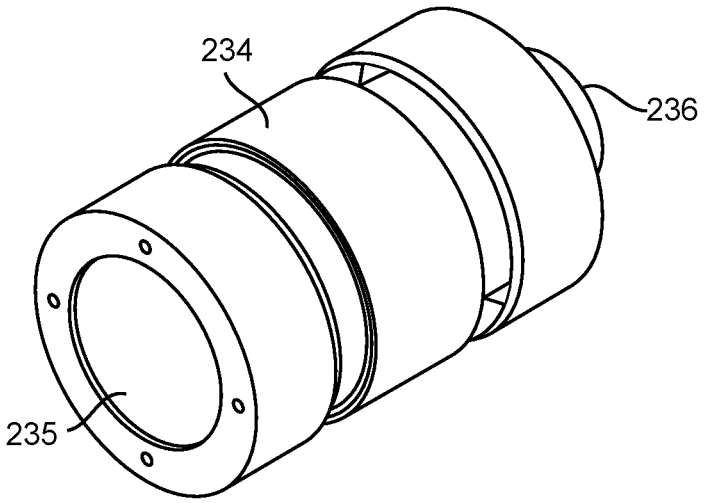
FIG. 24 illustrates a front top side perspective view of an alternative embodiment of the sound suppressor of the present invention for use in an internal combustion engine.

FIG. 24 illustrates a front top side perspective view of an alternative embodiment of the sound suppressor of the present invention for use in an internal combustion engine. The suppressor includes two pairs of toroidal whistles designed so that their spacing is one half-wavelength of their designed frequency. The suppressor may include three components or pieces sandwiched together along with two end caps bolted on, and then mounted to the internal combustion engine, for example, via an adapter. As shown in FIG. 24, the suppressor includes a suppressor canister 234 having a forward end 235 and a rear end 236.

Figure 25:
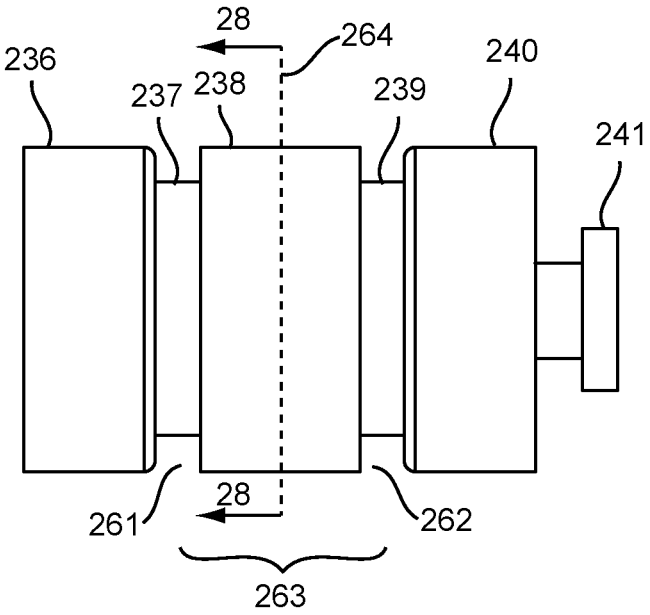
FIG. 25 illustrates a side plan view of the sound suppressor of FIG. 24.

FIG. 25 illustrates a side plan view of the sound suppressor of FIG. 24, which has a single set of paired whistles 261, 262. The suppressor of FIG. 24 includes a forward inner core 237, a centerpiece 238, a back inner core 239, two end caps 236, 240, and an adapter tube 241. The three components 237, 238, 239 are sandwiched together. The end caps 236, 240 may be identical, and are bolted onto the ends of the cores 237, 239, respectively. The dimension 263 is the half-wavelength of the pair of whistles 261, 262.

Figure 26:
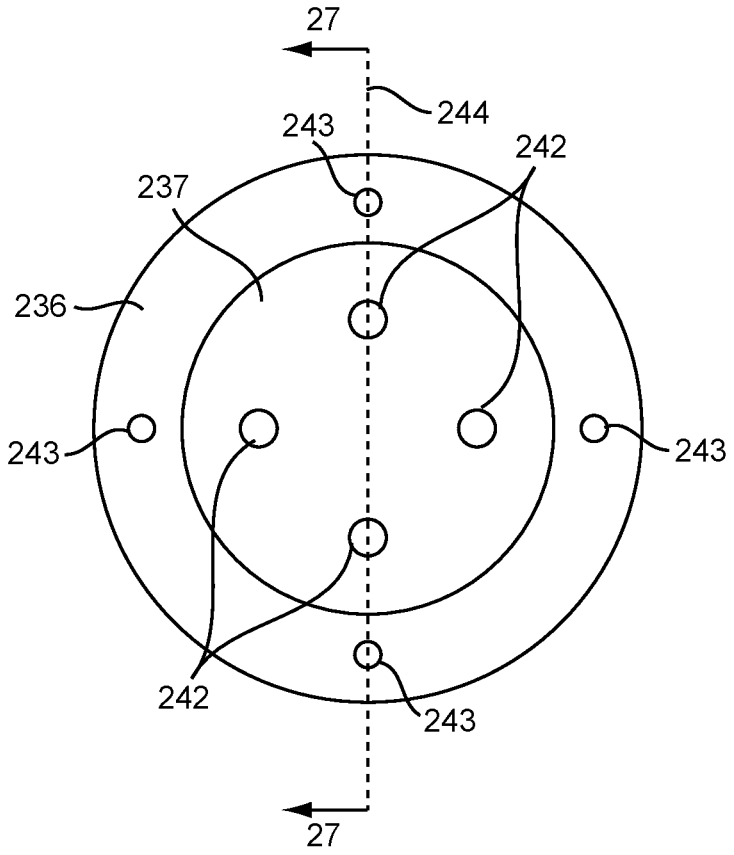
FIG. 26 illustrates a front plan view of the forward end of the sound suppressor of FIG. 24.

FIG. 26 illustrates a front plan view of the forward end of the sound suppressor of FIG. 24, with the locations 242 for bolts which hold the forward inner core 237, the center piece 238, and the rear inner core 239 together by threading into the forward face of the adapter tube 241, shown in FIG. 25. The locations 243 of additional bolts attach the end caps 236, 240 to the inner cores 237, 239, respectively. A line 244 represents a plane which symmetrically divides the suppressor along a vertical direction.

Figure 27:
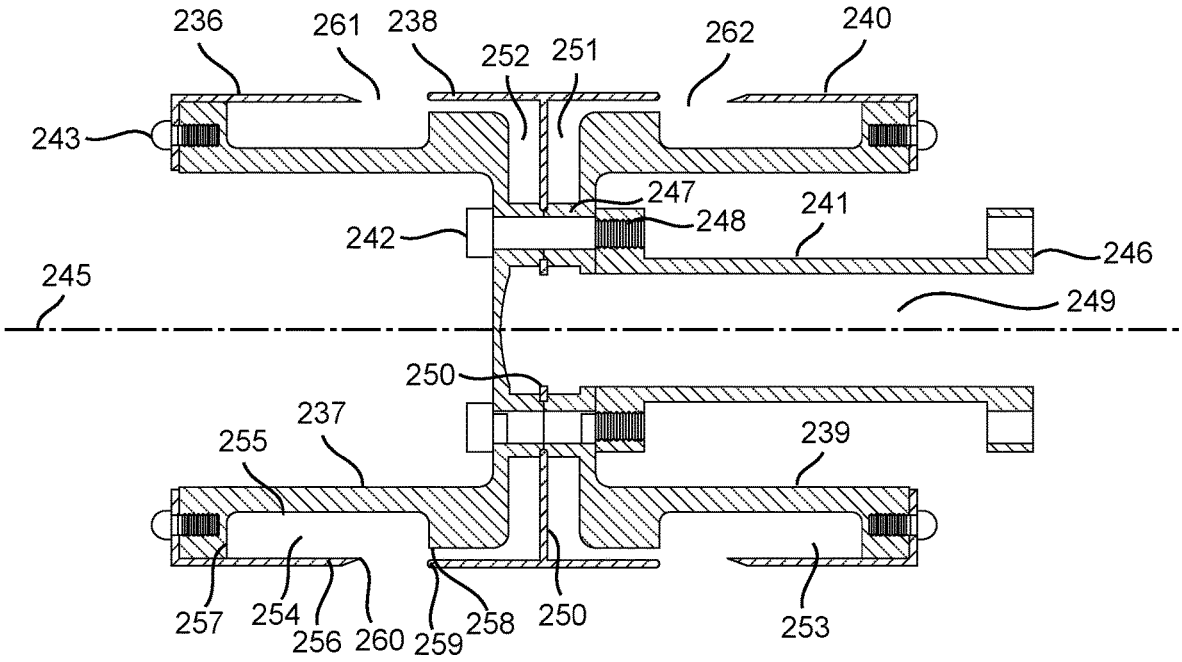
FIG. 27 illustrates a side cross-sectional view of the sound suppressor of FIG. 24 along lines 27-27 in FIG. 26.

FIG. 27 illustrates a side cross-sectional view of the sound suppressor of FIG. 24 along lines 27-27 in FIG. 26. As shown in FIG. 27, the suppressor is cylindrically symmetrical about the central axis 245, so while lines and corners above and below the central axis 245 are depicted as mirror images of each other, the lines and corners are actually the same edge, except for the bolt locations 242, 243, 248, as well as the embossed stations 247. It should be understood that all labels and index lines that refer to a feature on the top half of FIG. 27 also apply to the corresponding feature on the bottom half, and vice versa.

The suppressor for internal combustion engines includes the forward inner core 237, a centerpiece 238, the back inner core 239, two end caps 236, 240, and an adapter tube 241. The three components 237, 238, 239 are sandwiched together by bolts at the locations 242 which thread into the adapter tube 248. The bolts at the locations 242 go through cylindrical stanchions 247 embossed on the inboard sides of the inner cores 237, 239. The center piece 238 is held in position by being squeezed between the stanchions 247 of the inner cores 237, 239. The end caps 236, 240 may be identical and are attached to the ends of 237, 239, respectively, via bolts at the locations 243. The rear face 246 of the adapter tube 241 is shaped to mate to the engine exhaust port/manifold of the internal combustion engine, and the components 261, 262 are the forward and rear whistles, respectively.

The exhaust gas from the engine travels through the adapter tube 249. The center piece 238 acts as a flow divider, dividing the gas flow into the channels 251, 252. The exact dimensions and shapes of the channels 251, 252 cause the flow out of the components 261, 262 to be approximately equal in volume and pressure. The gas from the channel 251 then flows into the cavity 253 of the rear whistle, while the gas from the channel 252 flows into the cavity 254 of the forward whistle. The cavity dimensions of both whistles may be identical. Referring to FIG. 27, each cavity has a rectangular cross-section with dimensions described as follows: the height of each cavity is the dimension from the chamfered edge 260 to the back wall 257 of the cavity. The width of the cavity is the distance of the inner diameter wall 255 of the cavity to the outer diameter wall 256 of the cavity. After cavitating in the whistle cavities 253 and 254, the gas flows through the orifices 261, 262, respectively, creating a distinct whistle pitch. The edge 260 is chamfered to provide the most laminar flow out of the whistle and best facilitate the whistle effect.

The frequency of a whistle is, for the most part, determined by the dimensions of the cavity and the exit orifice, so the dimensions of the whistle cavities 253, 254, as well as the position of the components 261, 262 relative to each other, are all carefully coordinated and set so that dimension 263 is the length of one-half wavelength of the whistle tone created by the whistle cavities. The whistles produce the same frequency pitch at the same amplitude to have the maximal destructive interference effect.

Because the pair of whistles destructively interferes with itself, there's no theoretical requirement for a second pair of whistles. However, if a hole were drilled through the center of the component 237, a second adapter tube could be attached, and another suppressor canister added in a sort of "daisy" chain. The second pair of whistles would be essentially identical in setup to the first pair of whistles. However, because there is less incoming gas flow to the second pair of whistles, different shapes and dimensions may be configured relative to the channels on the first pair of whistles. Because each pair of whistles acts to destructively interfere with itself, there is also no requirement that the cavities of the second pair of whistles match the cavities of the first pair. Considering the entirety of the exhaust flow can be directed through the first pair of whistles, additional pairs of whistles may not be necessary.

Figure 28:
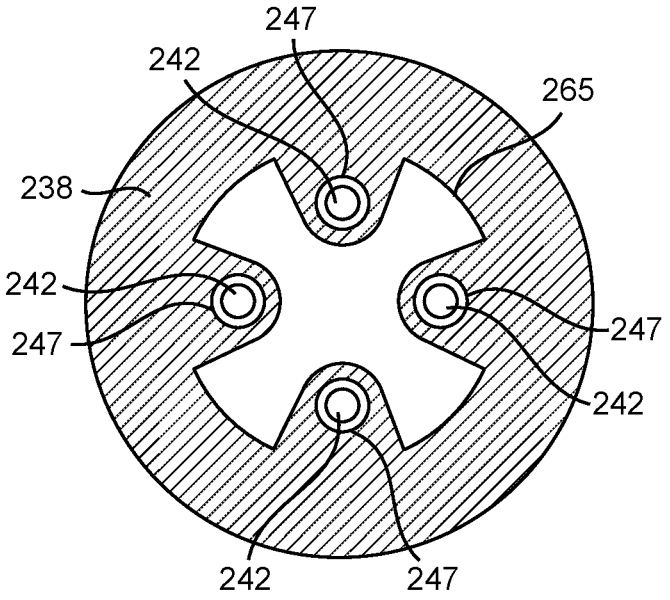
FIG. 28 illustrates a cross-sectional view of the sound suppressor of FIG. 25 along lines 28-28 in FIG. 25.

FIG. 28 illustrates a cross-sectional view of the sound suppressor of FIG. 25 along lines 28-28 in FIG. 25, with the center piece 238 having cylindrical stanchions 247 in which bolts 242 are positioned. The bolts 242 hold the components 237, 238, 239 together. The edge 265 is a flow divider portion of the center piece 238, with the edge 265 being chamfered to allow for a better division of the gas flow.

In a further alternative embodiment of the firearms application, the use of ports and whistle technology for causing destructive interference of sounds from a firearm, as described herein, may also be incorporated into the overall design of a firearm (e.g. with overboard ports located in the grooves of a rifled barrel). This eliminates the need for a bolt-on style suppressor that extends the length and moment arm of the barrel/firearm, and which makes the firearm more maneuverable in tight quarters and lighter for more comfortable carrying and firing.

The present invention may be embodied in other specific forms without departing from its spirit or essential characteristics. The described embodiments are to be considered in all respects only as illustrative and not restrictive. The scope of the invention, therefore, will be indicated by claims rather than by the foregoing description. All changes, which come within the meaning and range of equivalency of the claims, are to be embraced within their scope.

What is claimed is:

1. A sound suppressor comprising:

a tubular housing including an outer surface and an inner surface defining a core channel, the core channel having an upstream end with a core inlet for receiving an expulsed gas from a device and a downstream end with a core outlet for discharging a portion of the expulsed gas from the device;

a plurality of whistles having a corresponding plurality of ports which are in fluid communication with the core channel, each whistle including a secondary channel having a first end defining an inlet in fluid communication with the core channel and a second end coupled to a resonator cavity, each resonator cavity having a corresponding one of the plurality of ports for discharging a second portion of the expulsed gas from the device externally of the outer surface of the tubular housing, wherein each resonator cavity and associated port is configured and dimensioned to produce a narrow band of soundwave frequencies from a wide band of soundwave frequencies of the expulsed gas, the plurality of whistles being in a predetermined spaced-apart arrangement such that at least a pair of the plurality of whistles are spaced and arranged with respect to each other to discharge their corresponding second portions of the expulsed gas from the core channel so as to suppress the soundwaves produced by the expulsed gas using destructive interference of the soundwaves being expulsed by the pair of plurality of ports.

2. The sound suppressor of claim 1, wherein one port of each pair of the plurality of whistles is at least partially out of phase with respect to time to the other port of the pair of whistles to thereby create the destructive interference of the soundwaves.

3. The sound suppressor of claim 1, wherein the gas is generated by combustion in the device.

4. The sound suppressor of claim 1, wherein the plurality of ports and resonator cavities are configured to be tuned to a predetermined frequency.

5. The sound suppressor of claim 1, wherein the core channel of the housing further includes:

an angled baffle to delay a pressure wave of the gas from arriving at a first port, thereby causing the destructive interference.

6. The sound suppressor of claim 1, wherein at least a pair of ports of the plurality of ports is positioned a distance apart, so that a sound wave traveling from one port arrives at an adjacent paired port out of phase to the adjacent port's sound wave.

7. The sound suppressor of claim 1, further comprising:

a structure selected from a cover, a sheath, and an obstruction, wherein the structure is adjacent and exterior to one or more of the plurality of ports for managing a direction of the gas from the device.

8. The sound suppressor of claim 1, further comprising:

a structure selected from a cover, a sheath, and an obstruction, wherein the structure is adjacent and exterior to one or more of the plurality of ports for managing a direction of the soundwaves of the sound to increase at least one of a level or an efficiency of the destructive interference.

9. The sound suppressor of claim 1, wherein at least one of the whistles is positioned to cause the soundwaves of the sound produced by a first whistle in a group to arrive at the position of a second whistle in the same group and out of phase with the soundwave of the second whistle.

10. The sound suppressor of claim 1, wherein the plurality of ports are formed through the inner and outer surfaces of the tubular housing.

11. The sound suppressor of claim 1, wherein each inlet of the secondary channel extends directly from the core channel.

12. The sound suppressor of claim 1 further comprising a baffle extending into the core channel proximate each inlet to direct the expulsed gas flowing through the core channel through the corresponding secondary channel.

13. The sound suppressor of claim 1, wherein the pair of whistles share a common inlet formed at the core channel.

14. The sound suppressor of claim 13, wherein the corresponding secondary channels of the pair of whistles have different lengths as between the common inlet and the corresponding resonator cavity.

15. The sound suppressor of claim 1, wherein each resonator cavity is positioned between the core channel and the outer surface of the tubular housing.

16. The sound suppressor of claim 1, wherein each resonator cavity is positioned externally from the outer surface of the tubular housing.

17. The sound suppressor of claim 1, wherein the corresponding inlets of the secondary channels of the pair of the plurality of whistles are spaced upstream and downstream with respect to each other, such that propagation of a first soundwave through the second secondary channel and port of the downstream whistle of the pair of whistles is delayed with respect to propagation of a second soundwave through the second secondary channel and port of the upstream whistle of the pair of whistles.

18. The sound suppressor of claim 1, wherein the corresponding ports of the secondary channels of the pair of the plurality of whistles are spaced upstream and downstream with respect to each other.

19. A sound suppressor comprising:

a housing including:

an interior channel for receiving a gas from a device;

a plurality of ports connected to the interior channel for operating as whistles to suppress sound produced by the gas using destructive interference of the sound, the whistles being arranged in at least pairs, each whistle including a resonator cavity having one of the plurality of ports and a secondary channel in fluid communication between the interior channel and resonator cavity; and wherein the secondary channels of each at least pair of whistles are spaced-apart a predetermined distance from each other at the interior channel, and the ports of each at least pair of whistles are spaced-apart a predetermined distance from each other to suppress soundwaves produced by the gas from the device externally of an outer surface of the housing, such that the at least pair of whistles provide destructive interference of the soundwaves while being expulsed through the pair of plurality of ports.

20. The sound suppressor of claim 19, wherein one port of each at least pair of the plurality of whistles is at least partially out of phase with respect to time to the other port of the at least pair of whistles to thereby create the destructive interference of the soundwaves.

21. The sound suppressor of claim 19, wherein the gas is generated by combustion in the device.

22. The sound suppressor of claim 19, wherein the plurality of ports and resonator cavities are configured to be tuned to a predetermined frequency.

23. The sound suppressor of claim 19, wherein the interior channel of the housing further includes:

an angled baffle to delay a pressure wave of the gas from arriving at a first port, thereby causing the destructive interference.

24. The sound suppressor of claim 19, wherein the at least pair of whistles is a pair of whistles respectively having a pair of ports which are positioned apart by half of a predetermined wavelength, thereby causing the destructive interference.

25. A method for suppressing sound from a device using a sound suppressor, the sound suppressor including an interior channel for receiving a gas from a device; a plurality of ports connected to the interior channel for operating as whistles to suppress sound produced by the gas using destructive interference of the sound, the whistles being arranged to operate in at least pairs, each whistle including a resonator cavity having one of the plurality of ports and a secondary channel in fluid communication between the interior channel and resonator cavity; and wherein the secondary channels of each at least pair of whistles are spaced-apart a predetermined distance from each other at the interior channel, and the ports of each at least pair of whistles are spaced-apart a predetermined distance from each other to suppress soundwaves produced by the gas from the device, the method comprising:

receiving, at the interior channel of the housing, the gas from the device;

directing the gas from the interior channel to the ports of the at least pair of whistles via the respective secondary channels and resonator cavities of the at least pair of whistles; and expulsing the gas through the ports of the at least pair of whistles externally of an outer surface of the housing and using the destructive interference of the sound-waves generated by the gas to thereby suppress the sound.

26. The method of claim 25, further comprising:

generating the gas by combustion in the device.

27. The method of claim 25, further comprising:

directing the gas to the respective secondary channels of the pair of whistles by a baffle extending into the interior channel; and delaying a pressure wave of the gas from arriving at a first port, thereby causing the destructive interference.

28. The method of claim 25, wherein the at least pair of whistles is a pair of whistles, the method further comprising:

positioning the respective ports of the pair of whistles apart by half of a predetermined wavelength, thereby causing the destructive interference.

* * * * *